US008325100B2

(12) United States Patent
Choi et al.

(10) Patent No.: US 8,325,100 B2
(45) **Date of Patent: *Dec. 4, 2012**

(54) ANTENNA STRUCTURES MADE OF BULK-SOLIDIFYING AMORPHOUS ALLOYS

(75) Inventors: Yun-Seung Choi, Irvine, CA (US); James Kang, Laguna Hills, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/225,747

(22) Filed: Sep. 6, 2011

(65) Prior Publication Data

US 2011/0316761 A1 Dec. 29, 2011

Related U.S. Application Data

(63) Continuation of application No. 11/884,431, filed as application No. PCT/US2006/005815 on Feb. 17, 2006, now Pat. No. 8,063,843.

(60) Provisional application No. 60/654,639, filed on Feb. 17, 2005.

(51) Int. Cl.
*H01Q 1/00* (2006.01)

(52) U.S. Cl. ..... 343/787; 343/702; 343/788

(58) Field of Classification Search ..... 343/702, 343/787, 788

See application file for complete search history.

(56) References Cited

U.S. PATENT DOCUMENTS

| | | | |
|---|---|---|---|
| 3,989,517 | A | 11/1976 | Tanner et al. |
| 4,050,931 | A | 9/1977 | Tanner et al. |
| 4,064,757 | A | 12/1977 | Hasegawa |
| 4,067,732 | A | 1/1978 | Ray |
| 4,113,478 | A | 9/1978 | Tanner et al. |
| 4,116,682 | A | 9/1978 | Polk et al. |
| 4,116,687 | A | 9/1978 | Hasegawa |
| 4,126,449 | A | 11/1978 | Tanner et al. |
| 4,135,924 | A | 1/1979 | Tanner et al. |
| 4,148,669 | A | 4/1979 | Tanner et al. |
| 4,623,387 | A | 11/1986 | Masumoto et al. |
| 4,648,609 | A | 3/1987 | Deike |
| 4,721,154 | A | 1/1988 | Christ et al. |
| 4,743,513 | A | 5/1988 | Scruggs |
| 4,976,417 | A | 12/1990 | Smith |
| 4,978,590 | A | 12/1990 | Granata, Jr. et al. |
| 4,987,033 | A | 1/1991 | Abkowitz et al. |

(Continued)

FOREIGN PATENT DOCUMENTS

| | | |
|---|---|---|
| EP | 0554581 | 8/1993 |

(Continued)

OTHER PUBLICATIONS

Hasegawa et al., "Superconducting Properties of Be-Zr Glassy Alloys Obtained by Liquid Quenching", May 9, 1977, vol. 12, pp. 703-708.

(Continued)

*Primary Examiner* — Tho G Phan

(74) *Attorney, Agent, or Firm* — Pillsbury Winthrop Shaw Pittman LLP; Raj S. Dave

(57) ABSTRACT

Antenna structures made of bulk-solidifying amorphous alloys and methods of making antenna structures from such bulk-solidifying amorphous alloys are described. The bulk-solidifying amorphous alloys providing form and shape durability, excellent resistance to chemical and environmental effects, and low-cost net-shape fabrication for the highly intricate antenna shapes.

29 Claims, 2 Drawing Sheets

Schematic forms of antenna structures in wire form (circualr cross-section). For illustrative purposes only.

U.S. PATENT DOCUMENTS

| | | | | |
|---|---|---|---|---|
| 4,990,198 | A | 2/1991 | Masumoto et al. | |
| 5,032,196 | A | 7/1991 | Masumoto et al. | |
| 5,053,084 | A | 10/1991 | Masumoto et al. | |
| 5,053,085 | A | 10/1991 | Masumoto et al. | |
| 5,213,148 | A | 5/1993 | Masumoto et al. | |
| 5,250,124 | A | 10/1993 | Yamaguchi et al. | |
| 5,279,349 | A | 1/1994 | Horimura | |
| 5,288,344 | A | 2/1994 | Peker et al. | |
| 5,302,471 | A | 4/1994 | Ito et al. | |
| 5,324,368 | A | 6/1994 | Masumoto et al. | |
| 5,368,659 | A | 11/1994 | Peker et al. | |
| 5,380,375 | A | 1/1995 | Hashimoto et al. | |
| 5,384,203 | A | 1/1995 | Apfel | |
| 5,449,425 | A | 9/1995 | Renard et al. | |
| 5,482,580 | A | 1/1996 | Scruggs et al. | |
| 5,567,251 | A | 10/1996 | Peker et al. | |
| 5,567,537 | A | 10/1996 | Yoshizawa et al. | |
| 5,625,366 | A | 4/1997 | D'Hont | |
| 5,634,989 | A | 6/1997 | Hashimoto et al. | |
| 5,711,363 | A | 1/1998 | Scruggs et al. | |
| 5,797,443 | A | 8/1998 | Lin et al. | |
| 5,886,254 | A | 3/1999 | Chi | |
| 5,950,704 | A | 9/1999 | Johnson et al. | |
| 6,021,840 | A | 2/2000 | Colvin | |
| 6,027,586 | A | 2/2000 | Masumoto et al. | |
| 6,044,893 | A | 4/2000 | Taniguchi et al. | |
| 6,200,685 | B1 | 3/2001 | Davidson et al. | |
| 6,203,936 | B1 | 3/2001 | Cisar et al. | |
| 6,258,183 | B1 | 7/2001 | Onuki et al. | |
| 6,306,228 | B1 | 10/2001 | Inoue et al. | |
| 6,371,195 | B1 | 4/2002 | Onuki et al. | |
| 6,376,091 | B1 | 4/2002 | Croopnick | |
| 6,408,734 | B1 | 6/2002 | Cohen | |
| 6,446,558 | B1 | 9/2002 | Peker et al. | |
| 6,927,738 | B2 * | 8/2005 | Senba et al. | 343/787 |
| 6,980,171 | B2 * | 12/2005 | Maruyama et al. | 343/788 |
| 7,274,337 | B2 * | 9/2007 | Takakura | 343/788 |
| 7,295,168 | B2 * | 11/2007 | Saegusa et al. | 343/788 |
| 7,463,208 | B2 * | 12/2008 | Araki et al. | 343/787 |
| 7,495,625 | B2 | 2/2009 | Endo et al. | |
| 7,570,223 | B2 * | 8/2009 | Herzer et al. | 343/787 |
| 8,063,843 | B2 * | 11/2011 | Choi et al. | 343/787 |
| 2001/0052406 | A1 | 12/2001 | Kubota et al. | |
| 2002/0036034 | A1 | 3/2002 | Xing et al. | |
| 2002/0050310 | A1 | 5/2002 | Kundig et al. | |
| 2002/0187379 | A1 | 12/2002 | Yasuo et al. | |

FOREIGN PATENT DOCUMENTS

| | | |
|---|---|---|
| EP | 1484816 | 12/2004 |
| JP | 359013056 | 1/1984 |
| JP | 06-264200 | 9/1994 |
| JP | 2000-256811 | 9/2000 |
| JP | 02000277127 | 10/2000 |
| JP | 02001303218 | 10/2001 |
| WO | 2004/066322 | 8/2004 |
| WO | 2005/017219 | 2/2005 |
| WO | 2006/037093 | 4/2006 |

OTHER PUBLICATIONS

Inoue et al., "Zr-Al-Ni Amorphous Alloys with High Glass Transition Temperature and Significant Supercooled Liquid Region", Materials Transactions, JIM, 1990, vol. 31, No. 33, pp. 177-183.

Jost et al., "The Structure of Amorphous Be-Ti-Zr Alloys", Zeitschrift fur Physikalische Chemie Neue Folge, Bd., 1988, pp. 11-15.

Maret et al., "Structural study of Be.sub.43Hf.sub.xZr.sub.57-x Metallic Glasses by X-ray and Neutron Diffraction", J. Physique, 1986, vol. 47, pp. 863-871.

Tanner, "Metallic Glass Formation and Properties in Zr and Ti Alloyed with Be-I The Binary Zr-Be and Ti-Be Systems", Acta Metallurgica, 1979, vol. 27, pp. 1727-1747.

Tanner, "Physical Properties of Ti-Be-Si Glass Ribbons", Scripta Metallurgica, 1978, vol. 12, pp. 703-708.

Tanner et al, "Physical Properties of Ti.sub.50Be.sub.40zr10 Glass", Scripta Metallurgica, 1977, vol. 11, pp. 783-789.

Zhang et al., "Amorphous Zr-AI-TM (TM=Co, Ni, Cu) Alloys with Significant Supercooled Liquid Region of Over 100K", Materials Transactions, JIM, 1991, vol. 32, No. 11, pp. 1005-1010.

International Search Report for International Application PCT/US06/05815, Report completed May 5, 2008, Report mailed May 14, 2008, 3 pages.

* cited by examiner

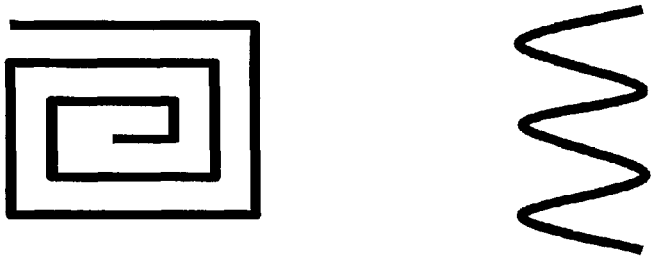
Figure 1: Schematic forms of antenna structures in wire form (circualr cross-section). For illustrative purposes only.
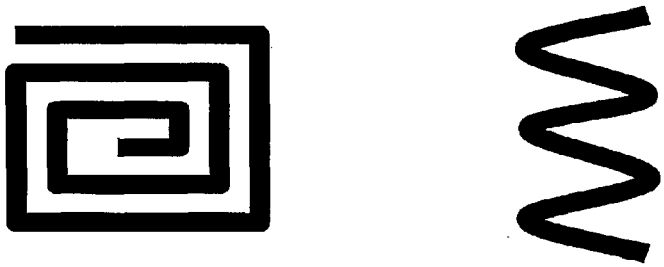
Figure 2: Schematic forms of antenna structures in thin strip form (rectangular cross-section). For illustrative purposes only.

ANTENNA STRUCTURES MADE OF BULK-SOLIDIFYING AMORPHOUS ALLOYS

CROSS REFERENCE TO RELATED APPLICATIONS

This application is a continuation of U.S. patent application Ser. No. 11/884,431, filed on Nov. 24, 2008, and is allowed on Jul. 21, 2011. The '431 application is a §371 application and claims priority from International Application PCT/US2006/005815 filed on Feb. 17, 2006, wherein that international application claims priority from U.S. Provisional Patent Application No. 60/654,639 filed on Feb. 17, 2005. The disclosure of each of the prior applications is considered part of and is incorporated by reference in the disclosure of this application.

FIELD OF THE INVENTION

The present invention is directed to antenna structures made of bulk solidifying amorphous alloys; and more particularly to antenna structures comprising components made of bulk solidifying amorphous alloys.

BACKGROUND OF THE INVENTION

Antenna structures are tools designed to receive and transmit electromagnetic signals for the purposes of data and voice transmission. In one particular form, receiving antenna, electromagnetic signal is received and collected from open environment and converted into electrical current, which is subsequently amplified and decoded for data and voice information.

Conventional antenna structures were generally made from metallic materials. The electrical conductivity and the relative structural integrity of conventional materials has been adequate for the intended purpose of past communication devices. However, the growth of mobile communications, such as the use of cell-phones and other wireless electronic devices with increasing data transfer, put more demand on antenna structures, such as requiring smaller and more compact forms albeit at more efficient collection and conversion of electromagnetic signals. Antennas for cell-phones are also made with new materials. For example, many cell phone antennas are constructed of plastics coated with high electrical conductivity materials such as gold. The easy and low cost fabrication of plastics has made it possible to make intricate antenna designs into more compact shapes. However, as these devices have become ever smaller and more fragile while at the same time being subjected to increased use and abuse in everyday life, the consistent performance of antenna structures has become crucial for the acceptance of a new generation of cell-phones and other wireless electronic devices by consumers.

Accordingly, a need exists for novel materials to be used in antenna structures, which can provide remedy to the deficiencies of incumbent materials and structures.

SUMMARY OF THE INVENTION

The current invention is generally directed to an antenna structure wherein at least a portion of the structure is made of bulk solidifying amorphous alloys.

In another embodiment of the invention, the antenna structure is compromised of an open sinuous form.

In yet another embodiment of the invention, the antenna structure is compromised of a two-dimensional percolating shape.

In yet another embodiment of the invention, the antenna structure is compromised of a three-dimensional percolating shape In still yet another embodiment of the invention, the surface of the antenna structure comprises a deposited conductive layer.

In still yet another embodiment of the invention, the surface of the antenna structure comprises a deposited coating layer comprised of one or more of noble metals.

In still yet another embodiment of the invention, the amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" in the range of from 0 to 50 in atomic percentages.

In still yet another embodiment of the invention, the amorphous alloy is described by the following molecular formula: $(Zr, Ti)_a(Ni, Cu)_b(Be)_c$, wherein "a" is in the range of from 40 to 75, "b" is in the range of from 5 to 50, and "c" in the range of from 5 to 50 in atomic percentages.

In still yet another embodiment of the invention, the amorphous alloy can sustain strains up to 1.5% or more without any permanent deformation or breakage.

In still yet another embodiment of the invention, the bulk solidifying amorphous alloy has a $\Delta T$ of 60° C. or greater.

In still yet another embodiment of the invention, the bulk solidifying amorphous has a hardness of 7.5 Gpa and higher.

In still yet another embodiment of the invention, the bulk solidifying amorphous alloy has an electrical resistivity of 400 micro ohm-cm or less.

In another alternative embodiment, the invention is also directed to methods of manufacturing antenna structures from bulk-solidifying amorphous alloys.

BRIEF DESCRIPTION OF THE DRAWINGS

These and other features and advantages of the present invention will be better understood by reference to the following detailed description when considered in conjunction with the accompanying drawings wherein:

FIG. 1, schematic forms of antenna structures in wire form (circular cross-section); and FIG. 2, schematic forms of antenna structures in thin strip form (rectangular cross-section).

DESCRIPTION OF THE INVENTION

Figure 3:
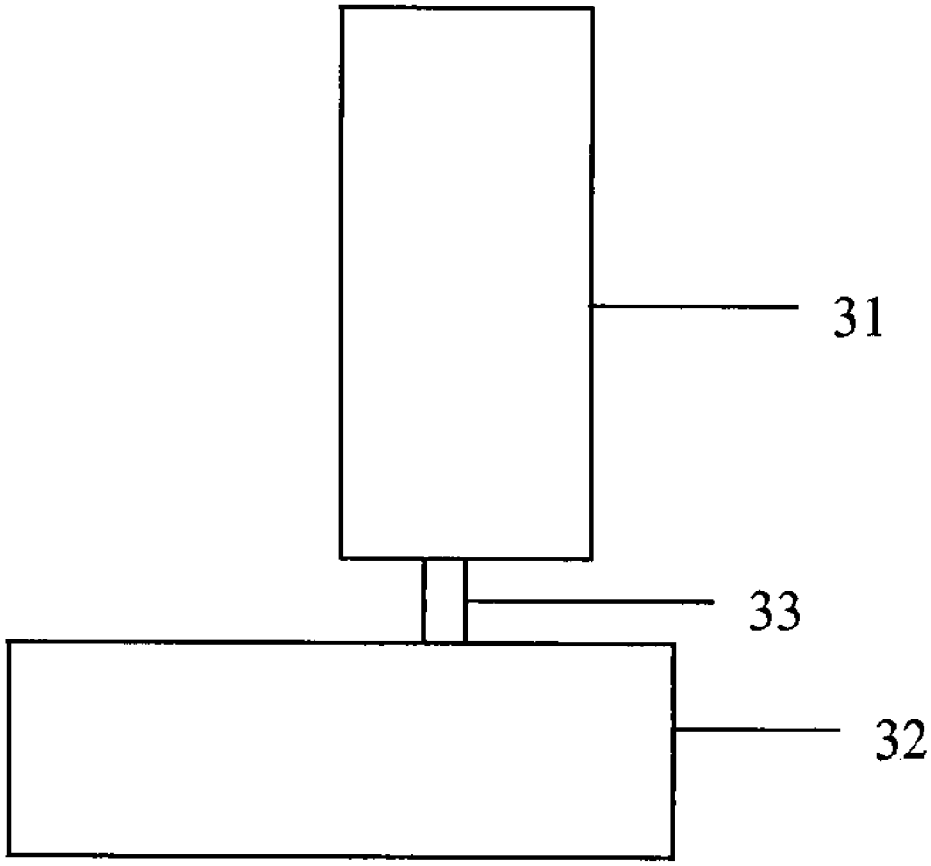
FIG. 3 provides a schematic of an antenna in one embodiment, wherein the antenna comprises a receiving and/or transmitting structure 31, a device circuit 32, and at least one connecting element 33 connecting the 31 and 32.

Antenna structures are generally in the form of open percolating structures and can be in shapes such as, plates, connected poles, wires and strips. Generally one or two ends of those structures are connected to the electrical circuit of the telecommunication device through a connecting element, converting electromagnetic signal into the circuit current. FIGS. 1 and 2 depict various antenna structures in accordance with the current invention in schematic form. Although these figures show acceptable antenna designs, it should be understood that the current invention can be applied to any antenna shape. For example, it is also common that the antenna structure takes sinuous or serpentine shape in order to improve the gain and collection of electromagnetic signals. The particular design and shape of antenna structures is extremely critical for an effective collection and conversion of electromagnetic signals. As the electromagnetic signals are collected and converted into electrical current at various portions of antenna structures, this collection and conversion process must be "in-phase" for the high-efficiency functioning of antenna. When the intended shape and form of antenna gets distorted, the efficiency and effectiveness of antenna gets substantially reduced.

The current invention is directed to antenna structures made of bulk-solidifying amorphous alloys, the bulk-solidifying amorphous alloys providing form and shape durability, excellent resistance to chemical and environmental effects, and low-cost net-shape fabrication for highly intricate shapes. Another object of the current invention is a method of making antenna structures from such bulk-solidifying amorphous alloys.

Bulk solidifying amorphous alloys are a recently discovered family of amorphous alloys, which can be cooled at substantially lower cooling rates, of about 500 K/sec or less, and substantially retain their amorphous atomic structure. As such, they can be produced in thicknesses of 0.5 mm or more, substantially thicker than conventional amorphous alloys, which are typically limited to thicknesses of 0.020 mm, and which require cooling rates of $10^5$ K/sec or more. U.S. Pat. Nos. 5,288,344; 5,368,659; 5,618,359; and 5,735,975, the disclosures of which are incorporated herein by reference in their entirety, disclose such bulk solidifying amorphous alloys.

A family of bulk solidifying amorphous alloys can be described as $(Zr, Ti)_a(Ni, Cu, Fe)_b(Be, Al, Si, B)_c$, where a is in the range of from 30 to 75, b is in the range of from 5 to 60, and c in the range of from 0 to 50 in atomic percentages. Furthermore, these basic alloys can accommodate substantial amounts (up to 20% atomic, and more) of other transition metals, such as Nb, Cr, V, Co. A preferable alloy family is $(Zr, Ti)_a(Ni, Cu)_b(Be)_c$, where a is in the range of from 40 to 75, b is in the range of from 5 to 50, and c in the range of from 5 to 50 in atomic percentages. Still, a more preferable composition is $(Zr, Ti)_a(Ni, Cu)_b(Be)_c$, where a is in the range of from 45 to 65, b is in the range of from 7.5 to 35, and c in the range of from 10 to 37.5 in atomic percentages. Another preferable alloy family is $(Zr)_a(Nb, Ti)_b(Ni, Cu)_c(Al)_d$, where a is in the range of from 45 to 65, b is in the range of from 0 to 10, c is in the range of from 20 to 40 and d in the range of from 7.5 to 15 in atomic percentages.

Another set of bulk-solidifying amorphous alloys are ferrous metals (Fe, Ni, Co) based compositions. Examples of such compositions are disclosed in U.S. Pat. No. 6,325,868 and in publications to (A. Inoue et. al., Appl. Phys. Lett., Volume 71, p 464 (1997)), (Shen et. al., Mater. Trans., JIM, Volume 42, p 2136 (2001)), and Japanese patent application 2000126277 (Publ. #2001303218 A), all of which are incorporated herein by reference. One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$. Although, these alloy compositions are not processable to the degree of the Zr-base alloy systems, they can still be processed in thicknesses of 1.0 mm or more, sufficient enough to be utilized in the current invention.

Bulk-solidifying amorphous alloys have typically high strength and high hardness. For example, Zr and Ti-base amorphous alloys typically have yield strengths of 250 ksi or higher and hardness values of 450 Vickers or higher. The ferrous-base version of these alloys can have yield strengths up to 500 ksi or higher and hardness values of 1000 Vickers and higher. As such, these alloys display excellent strength-to-weight ratio. Furthermore, bulk-solidifying amorphous alloys have good corrosion resistance and environmental durability, especially the Zr and Ti based alloys. Amorphous alloys generally have high elastic strain limit approaching up to 2.0%, much higher than any other metallic alloy.

In general, crystalline precipitates in bulk amorphous alloys are highly detrimental to the properties of amorphous alloys, especially to the toughness and strength of these alloys, and as such it is generally preferred to minimize the volume fraction of these precipitates. However, there are cases in which, ductile crystalline phases precipitate in-situ during the processing of bulk amorphous alloys, which are indeed beneficial to the properties of bulk amorphous alloys, especially to the toughness and ductility of the alloys. Such bulk amorphous alloys comprising such beneficial precipitates are also included in the current invention. One exemplary case is disclosed in (C. C. Hays et. al, Physical Review Letters, Vol. 84, p 2901, 2000), which is incorporated herein by reference.

As a result of the use of these bulk-solidifying amorphous alloys, the antenna structures of the present invention have characteristics that are much improved over conventional antenna structures made of ordinary metallic materials or coated-plastic combinations. The surprising and novel advantages of using bulk-solidifying amorphous alloys in producing antenna structures will be described in various embodiments below.

First, the unique amorphous atomic structure, of the bulk solidifying amorphous alloys provide a featureless microstructure providing consistent properties and characteristics which can be achieved substantially better than conventional metallic alloys. The general deficiencies of multi-phase and poly-crystalline microstructure are not applicable. The inventors discovered that the surfaces of exemplary bulk solidifying amorphous alloys can be polished to very high degrees of smoothness, which can provide an excellent substrate for critical conductive layers. Accordingly, the quality of the reflective surfaces of bulk solidifying amorphous alloys substantially become better than conventional metals and alloys.

Secondly, the combination of high strength and high strength-to-weight ratio of the bulk solidifying amorphous alloys significantly reduces the overall weight and bulkiness of antenna structure of the current invention, thereby allowing for the reduction of the thickness of these antenna structures without jeopardizing the structural integrity and operation of mobile devices into which these antenna structures are integrated. The ability to fabricate antenna structures with thinner walls is also important in reducing the bulkiness of the antenna system and increasing the efficiency per-volume. This increased efficiency is particularly useful for the application of antenna structures in advanced mobile devices and equipment.

As discussed, bulk solidifying amorphous alloys have very high elastic strain limits, typically around 1.8% or higher. This is an important characteristic for the use and application for antenna structures. Specifically, high elastic strain limits are preferred for devices mounted in mobile devices, or in other applications subject to mechanical loading or vibration. A high elastic strain limit allows the antenna structures to take even more intricate shape and to be thinner and lighter, high elastic strain limits also allow the antenna structures to sustain loading and flexing without permanent deformation or destruction of the device, especially during assembly.

Other conventional metallic alloys, although not fragile, however, are prone to permanent deformation, denting and scratching due to low hardness values. The very large surface area and very small thicknesses of antenna structures makes such problems even more significant. However, bulk-solidifying amorphous alloys have reasonable fracture toughness, on the order of 20 ksi-sqrt(in), and high elastic strain limit, approaching 2%. Accordingly, high flexibility can be achieved without permanent deformation and denting of the antenna structure. As such, antenna structures made of bulk-solidifying amorphous alloys can be readily handled during fabrication and assembly, reducing the cost and increasing the performance of the antenna system.

In addition, antenna structures made of bulk solidifying amorphous alloy also have good corrosion resistance and high inertness. The high corrosion resistance and inertness of these materials are useful for preventing the antenna structures from being decayed by undesired chemical reactions between the antenna structures and the environment. The inertness of bulk solidifying amorphous alloy is also very important to the life of the antenna structure because it does not tend to decay and affect the electrical properties.

Another aspect of the invention is the ability to make antenna structure with isotropic characteristics and more specifically with isotropic microstructure. Generally non-isotropic micro-structures, such as elongated grains, in metallic articles causes degraded performance for those portions of metallic articles that require precision fit, such as in the contact surfaces of the formed antenna structures due to variations in temperature, mechanical forces, and vibration experienced across the article. Moreover, the non-uniform response of the ordinary metals in various directions, due to non-isotropic microstructure, would also require extensive design margins to compensate, and as such would result in heavy and bulky structures. Accordingly, the isotropic response of the antenna structures in accordance with the present invention is crucial, at least in certain designs, given the intricate and complex patterns and the associated large surface areas and very small thicknesses of the antenna structures, as well as the need to utilize high strength construction material. For example, the castings of ordinary alloys are typically poor in mechanical strength and are distorted in the case of large surface area and very small thickness. Accordingly, using metallic alloys for casting such large surface areas with high tolerance in flatness (or precisely curved shapes) is not generally feasible. In addition, for the ordinary metallic alloys, extensive rolling operations would be needed to produce the metallic antenna structure in the desired flatness and with the desired high strength. However, in this case the rolled products of ordinary high-strength alloys generate strong orientation in microstructure, and as such lack the desirable isotropic properties. Indeed, such rolling operations typically result in highly oriented and elongated crystalline grain structures in metallic alloys resulting in highly non-isotropic material. In contrast, bulk-solidifying amorphous alloys, due to their unique atomic structure lack any microstructure as observed in crystalline and grainy metal, and as a result articles formed from such alloys are inherently isotropic both at macroscopic and microscopic level.

Another object of the invention is providing a method to produce antenna structures in net-shape form from bulk solidifying amorphous alloys. The net-shape forming ability of bulk-solidifying amorphous alloys allow the fabrication of intricate antenna structures with high precision and reduced processing steps, such as, bending and welding which reduce the antenna performance. By producing antenna structures in net-shape form manufacturing costs can be significantly reduced while still forming antenna structures with good flatness, intricate surface features comprising precision curves, and high surface finish on the reflecting areas.

Although, bulk-solidifying amorphous alloys typically lower electrical conductivity values compared to high conductivity metals such as copper, this deficiency can be readily remedied by applying a highly conductive layer, such as nickel and gold plating. The net shape forming process of bulk-solidifying amorphous alloys allows consistent and durable conductive layers of high conductivity metals such as gold.

One exemplary method of making such antenna structure comprises the following steps:

1) Providing a sheet feedstock of amorphous alloy being substantially amorphous, and having an elastic strain limit of about 1.5% or greater and having a $\Delta T$ of 30° C. or greater;
2) Heating the feedstock to around the glass transition temperature;
3) Shaping the heated feedstock into the desired shape; and
4) Cooling the formed sheet to temperatures far below the glass transition temperature.

Herein, $\Delta T$ is given by the difference between the onset of crystallization temperature, $T_x$, and the onset of glass transition temperature, $T_g$, as determined from standard DSC (Differential Scanning Calorimetry) measurements at typical heating rates (e.g. 20° C./min).

Preferably $\Delta T$ of the provided amorphous alloy is greater than 60° C., and most preferably greater than 90° C. The provided sheet feedstock can have about the same thickness as the average thickness of the final antenna structure. Moreover, the time and temperature of the heating and shaping operation is selected such that the elastic strain limit of the amorphous alloy is substantially preserved to be not less than 1.0%, and preferably not being less than 1.5%. In the context of the invention, temperatures around glass transition means the forming temperatures can be below glass transition, at or around glass transition, and above glass transition temperature, but always at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Upon the finishing of the above-mentioned fabrication method, the shaped antenna structure can be subjected further surface treatment operations as desired such as to remove any oxides on the surface. Chemical etching (with or without masks) can be utilized as well as light buffing and polishing operations to provide improvements in surface finish can be achieved.

Another exemplary method of making antenna structures in accordance with the present invention comprises the following steps:

1) Providing a homogeneous alloy feedstock of amorphous alloy (not necessarily amorphous);
2) Heating the feedstock to a casting temperature above the melting temperatures;
3) Introducing the molten alloy into shape-forming mold; and
4) Quenching the molten alloy to temperatures below glass transition.

Bulk amorphous alloys retain their fluidity from above the melting temperature down to the glass transition temperature due to the lack of a first order phase transition. This is in direct contrast to conventional metals and alloys. Since, bulk amorphous alloys retain their fluidity, they do not accumulate significant stress from their casting temperatures down to below the glass transition temperature and as such dimensional distortions from thermal stress gradients can be minimized. Accordingly, antenna structures with large open surface area and small thickness can be produced cost-effectively.

Although specific embodiments are disclosed herein, it is expected that persons skilled in the art can and will design alternative amorphous alloy antenna structures and methods to produce the amorphous alloy antenna structures that are within the scope of the following claims either literally or under the Doctrine of Equivalents.

What is claimed is:

1. A communication device comprising an antenna comprising:

a receiving and/or transmitting structure; and at least one connecting element for connecting the receiving/transmitting structure to a device circuit, wherein at least one portion of the antenna is formed of bulk solidifying amorphous alloy, and wherein a smallest dimension of the portion formed of bulk solidifying amorphous alloy is 0.5 mm or more.

2. The communication device as in claim 1, wherein the smallest dimension of the portion formed of bulk solidifying amorphous alloy is 1 mm or more.

3. The communication device as in claim 1 wherein the receiving and/or transmitting structure is entirely made of bulk solidifying amorphous alloy.

4. The communication device as in claim 1 wherein the antenna is entirely made of bulk solidifying amorphous alloy.

5. The communication device as in claim 1, wherein the bulk solidifying amorphous alloy has an elastic strain limit of 1.5% or more.

6. The communication device as in claim 1, wherein the bulk solidifying amorphous alloy has an elastic strain limit of 1.8% or more.

7. The communication device as in claim 1, wherein the bulk solidifying amorphous alloy has a hardness of 4.5 GPa or higher.

8. The communication device as in claim 1, wherein the bulk solidifying amorphous alloy has a yield strength of 200 ksi or more.

9. The communication device as in claim 1, wherein the bulk solidifying amorphous alloy has an electrical resistivity of 400 micro ohm-cm or less.

10. The communication device as in claim 1, wherein the portion formed of bulk solidifying amorphous is coated with a second metallic material with a high electrical conductivity.

11. The communication device as in claim 1, wherein the portion formed of bulk solidifying amorphous is coated with Cu, Ni, Ag or Au.

12. The communication device as in claim 1, wherein the bulk solidifying amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" in the range of from 0 to 50 in atomic percentages.

13. The communication device as in claim 1, wherein the bulk solidifying amorphous alloy is described by the following molecular formula: $(Zr, Ti)_a(Ni, Cu)_b(Be)_c$, wherein "a" is in the range of from 40 to 75, "b" is in the range of from 5 to 50, and "c" in the range of from 5 to 50 in atomic percentages.

14. The communication device as in claim 1, wherein the bulk solidifying amorphous alloy has a $\Delta T$ of 60° C. or greater.

15. The communication device of claim 1, wherein the communication device comprises a wireless communication device.

16. The communication device of claim 1, wherein the communication device comprises a cell phone.

17. The communication device of claim 1, wherein the antenna has a shape of plate, pole, wire, strip or combinations thereof.

18. A communication device comprising an antenna comprising:

a receiving and/or transmitting structure; and at least one connecting element for connecting the receiving/transmitting structure to a device circuit, wherein at least one portion of the antenna is formed of bulk solidifying amorphous alloy, wherein the receiving/transmitting structure has an isotropic microstructure.

19. The communication device of claim 18, wherein the communication device comprises a wireless communication device.

20. The communication device of claim 18, wherein the communication device comprises a cell phone.

21. The communication device of claim 18, wherein the antenna has a shape of plate, pole, wire, strip or combinations thereof.

22. A communication device comprising an antenna comprising:

a receiving and/or transmitting structure; and at least one connecting element for connecting the receiving/transmitting structure to a device circuit, wherein at least one portion of the antenna is formed of a bulk solidifying amorphous alloy such that said portion has an isotropic microstructure.

23. The communication device of claim 22, wherein the communication device comprises a wireless communication device.

24. The communication device of claim 22, wherein the communication device comprises a cell phone.

25. The communication device of claim 22, wherein the antenna has a shape of plate, pole, wire, strip or combinations thereof.

26. A method of forming a communication device having an antenna, the method comprising net-shape fabricating one portion of the antenna from a bulk solidifying amorphous alloy by direct casting.

27. The method of claim 26, wherein the direct casting is done from a casting temperature above the melting temperature of the alloy.

28. The method of claim 26, wherein the direct casting is done from a casting temperature above the glass transition temperature of the alloy.

29. The method of claim 26, wherein the receiving and/or transmitting structure is cast from the bulk solidifying amorphous alloy.

* * * * *